US005647106A

United States Patent [19]

Hogan

[11] Patent Number: 5,647,106

[45] Date of Patent: Jul. 15, 1997

[54] ANTI-THEFT SYSTEM AND METHOD

[75] Inventor: Dennis L. Hogan, Lighthouse Point, Fla.

[73] Assignee: Sensormatic Electronics Corporation, Boca Raton, Fla.

[21] Appl. No.: 271,127

[22] Filed: Jul. 6, 1994

[51] Int. Cl.[6] ..... A44B 21/00

[52] U.S. Cl. ..... 24/704.1; 24/456; 24/355; 24/564

[58] Field of Search ..... 24/704.1, 704.2, 24/563, 564, 555, 456, 350, 355; 70/57.1

[56] References Cited

U.S. PATENT DOCUMENTS

| | | | |
|---|---|---|---|
| 446,564 | 2/1891 | Bacon | 24/564 X |
| 674,847 | 5/1901 | Lundburg | 24/564 X |
| 1,501,001 | 7/1924 | Lane | 24/456 X |
| 1,557,370 | 10/1925 | Lane | 24/456 X |
| 2,986,793 | 6/1961 | Bright | 24/564 |
| 3,942,829 | 3/1976 | Humble et al. . | |
| 3,947,930 | 4/1976 | Martens et al. . | |
| 4,012,813 | 3/1977 | Martens et al. . | |
| 4,103,572 | 8/1978 | Humble et al. . | |
| 4,254,868 | 3/1981 | Humble et al. . | |
| 4,299,870 | 11/1981 | Humble . | |
| 4,368,912 | 1/1983 | Holtz | 24/564 X |
| 4,505,010 | 3/1985 | Arenhold | 24/456 |
| 4,649,397 | 3/1987 | Heaton et al. | 24/57.1 X |
| 5,031,756 | 7/1991 | Buzzard et al. . | |
| 5,079,540 | 1/1992 | Narlow et al. . | |
| 5,140,836 | 8/1992 | Hogan et al. . | |
| 5,205,024 | 4/1993 | Willard . | |
| 5,309,740 | 5/1994 | Hansen . | |

*Primary Examiner*—James R. Brittain
*Attorney, Agent, or Firm*—Paul T. Kashimba; John T. Torrente

[57] ABSTRACT

A system for deterring theft is made up of a clamp for attaching to a small item of merchandise such as a wallet, check book wallet or pocketbook and a spreading tool for attaching the clamp to and removing it from the item. The clamp is a generally U-shaped clamp having two clamping arms with a relatively strong biasing force between them. Padding is provided on the inside surfaces of the clamping arms. At least one of the clamping arms is provided with teeth which, when the clamp is attached to the item, will cut into the surface of the item if an attempt is made to slide the clamp relative to the item. The spreading tool opens the clamping arms against the biasing force to allow the clamp to be attached to or removed from the item. The preferred tool has biasing springs which tend to keep the jaws in a nearly closed equilibrim position. In a second embodiment a sliding retainer keeps the clamp in place relative to the spreading tool while the clamp is being attached to the item. Flanges are also provided on the jaws of the spreading tool to hold the clamp in place. A method of deterring theft of an item of merchandise such as a wallet includes the steps of clamping a clamp to the item such that a billfold, credit card slot or check book slot is closed off by the clamp.

12 Claims, 6 Drawing Sheets

ANTI-THEFT SYSTEM AND METHOD

BACKGROUND

This invention relates generally to the field of theft deterrent systems. More particularly it relates to systems for deterring the theft of relatively small objects of merchandise such as wallets, pocketbooks, organizers and the like.

The problem of pilferage of merchandise is widespread, costing businesses many millions of dollars annually. This problem is particularly acute in the retail sales environment and especially in situations involving the display of relatively small articles which can easily be concealed by shoplifters. Special problems are presented by relatively high cost objects such as those made of leather including wallets and pocketbooks which are small enough to be concealed, but which potential purchasers prefer to examine closely before buying. There is therefore a need for a system which will deter theft while still permitting the potential customer to examine an item such as a wallet or a pocketbook prior to purchase.

Systems for clamping tags to small items such as eyeglasses and jewelry are known. See for example the system disclosed in U.S. Pat. No. 5,148,836 to the present inventor. Also known are devices for securing electronic tags and labels to articles. An approach used in clothing retailing is to provide a tag containing an ink vial which breaks if an attempt is made to remove the tag from the garment without a special tool. The ink permanently stains the garment, thus denying its benefit to the pilferer. A device of this type is described in U.S. Pat. No. 5,205,024. Such an approach is not very useful for objects made of leather and the like such as wallets.

There is therefore a need for a theft-deterrent device to deter the theft of objects such as wallets and which is relatively simple and inexpensive.

The present invention is directed towards a system and method for deterring the theft of objects such as wallets in a simple and highly cost effective manner by utilizing the benefit denial principle. More particularly, the present invention deters theft by at least partially destroying the object if an unauthorized attempt is made to remove the theft deterrent device. Unlike systems of the prior art, the present invention does not require complex tools for installation or removal of a theft deterrent device. In addition, the system is relatively inexpensive to manufacture and simple to use.

SUMMARY OF THE INVENTION

The present invention includes a system for deterring the theft of an object such as a wallet. The system comprises a clamp which is attachable to the object and a tool for attaching the clamp to or removing the clamp from the object. The clamp exerts a clamping force on the object, thus causing the clamp to grip the object firmly, such that the object cannot readily be removed from the clamp. The tool is adapted to overcome the clamping force, thereby opening the clamp so that the clamp can be attached to or removed from the object.

The invention also includes a method for deterring the theft of an object such as a wallet. The method comprises the steps of providing a theft deterrent device which comprises a clamp. The theft deterrent device is clamped to the object such that a clamping force is exerted between the clamp and the object, thereby causing the theft deterrent device to grip the object. The clamping force is such that the device cannot readily be removed from the object without using a special tool.

DETAILED DESCRIPTION

The following is a description of the preferred embodiment of a theft-deterrent system and method for its use. The system is particularly useful to deter the theft of devices such as wallets, pocketbooks and purses in a retail sales environment. The description is intended to be exemplary of the invention and not limiting. The full scope of the invention is to be determined by the appended claims and their equivalents.

Figure 6:
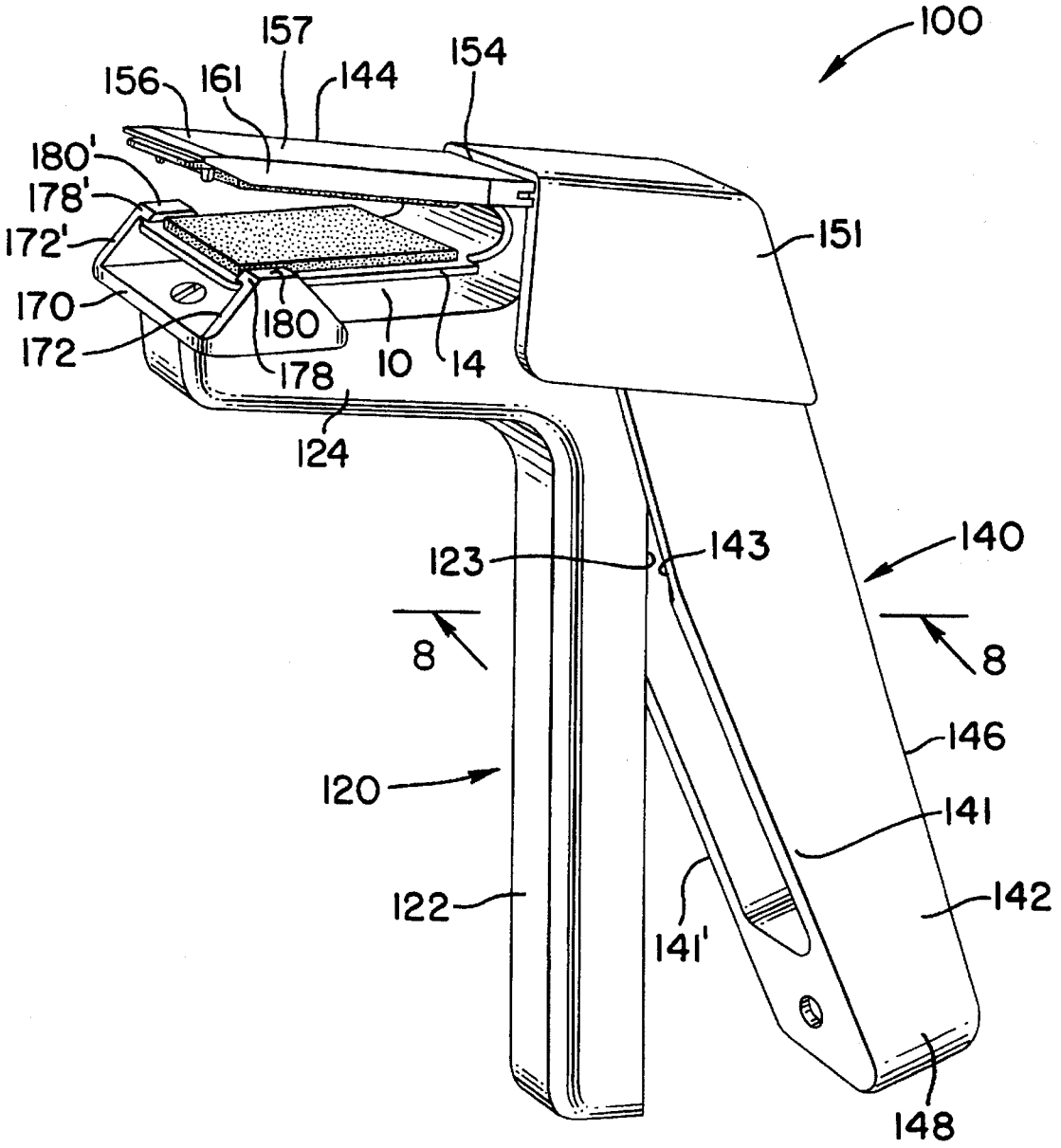
FIG. 6 is a perspective view of the preferred embodiment of the theft deterrent device attachment/detachment tool.
Figure 7:
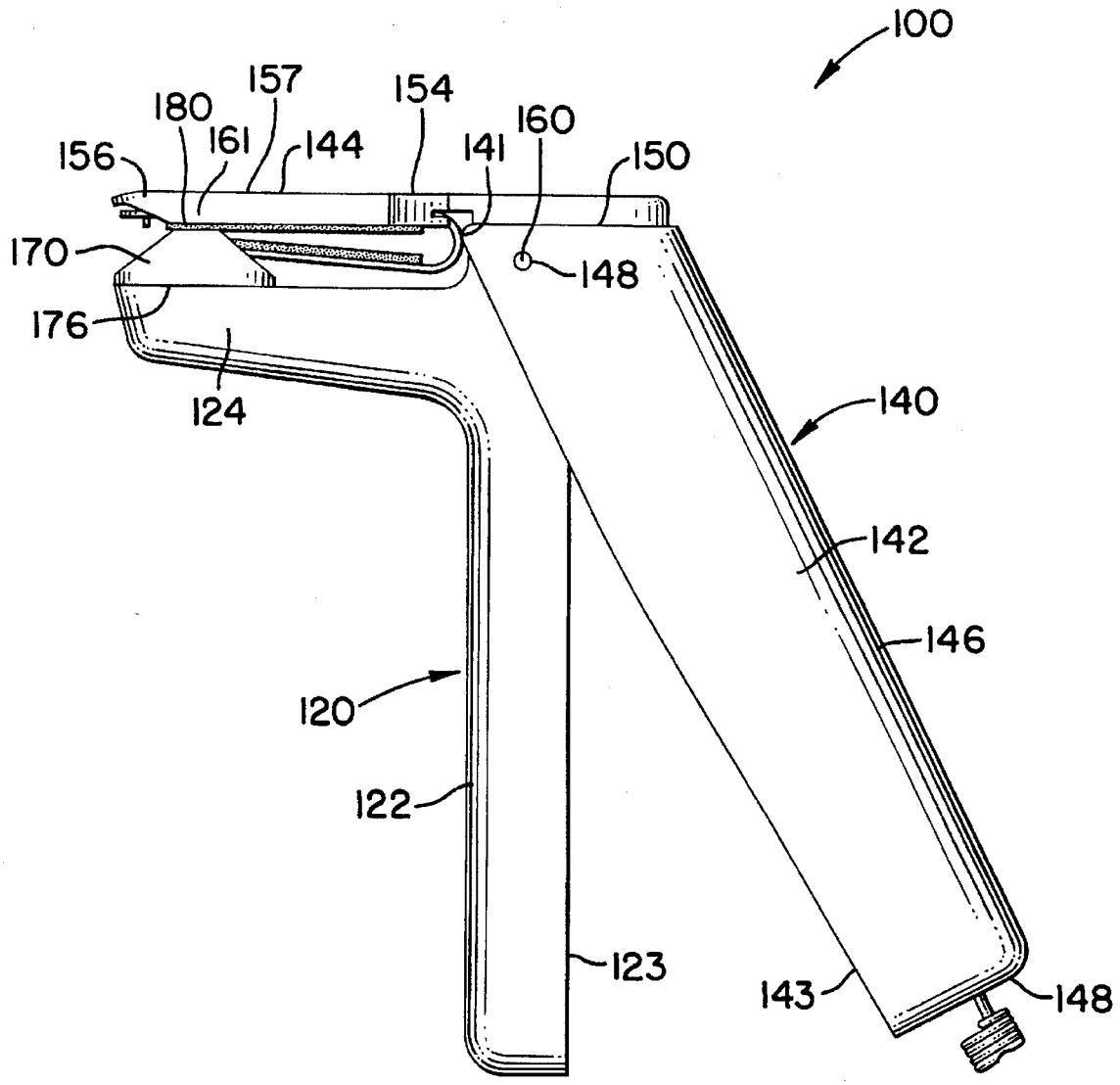
FIG. 7 is a side elevational view of the combination of the theft-deterrent device and the preferred attachment/detachment tool, with the theft deterrent device and tool in a closed position.
Figure 9:
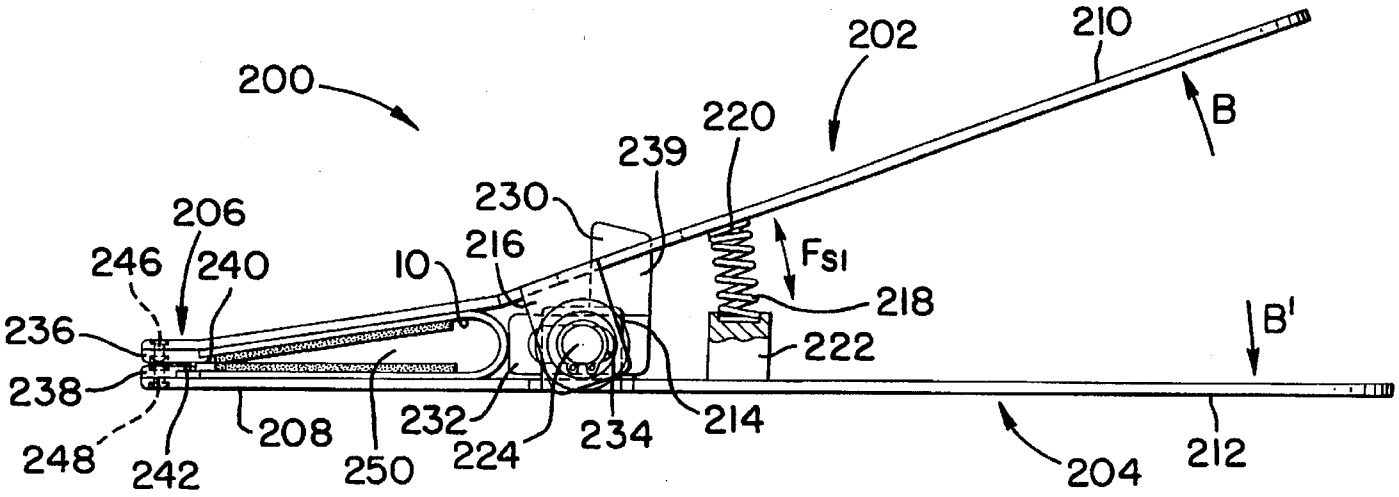
FIG. 9 is a side elevational view of a second embodiment of the tool with the theft-deterrent device in a closed position.
Figure 10:
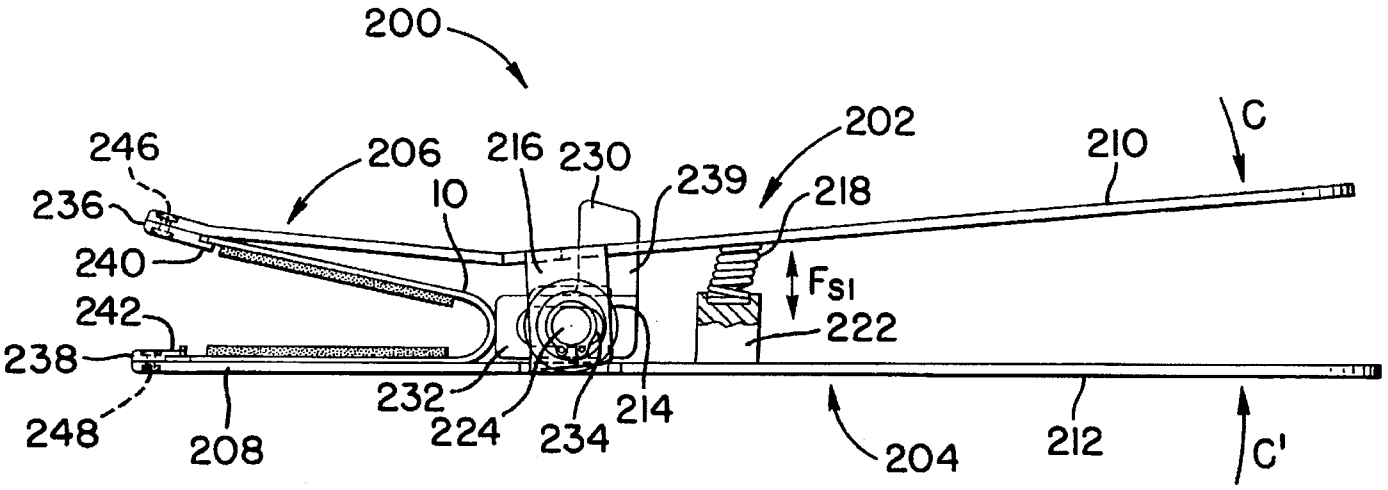
FIG. 10 is a side elevational view of the second embodiment of the tool with the theft-deterrent device in an open position.
Figure 8:
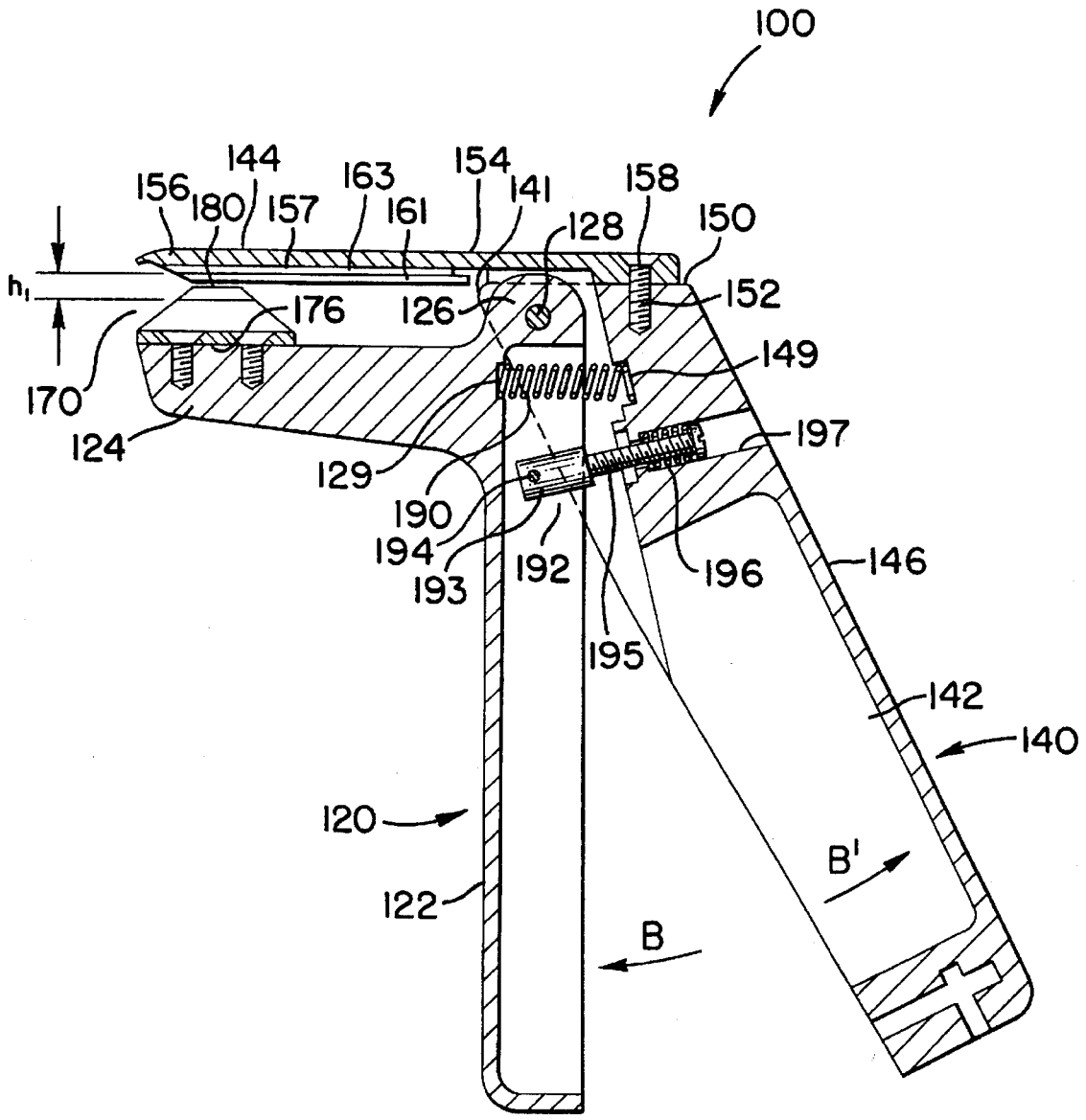
FIG. 8 is a cross-sectional view of the preferred attachment/detachment tool through section 8—8 of FIG. 6.

The theft-deterrent system is made up of an anti-theft device 10 (See FIG. 1) and an attachment/detachment tool 100 (See FIGS. 6–8 for the preferred embodiment. A second embodiment is shown in FIGS. 9–10). Each will be described separately.

Theft-deterrent device 10 is made up of a generally U-shaped clamp comprising two clamping arms—first clamping arm 12 and second clamping arm 14. First and second clamping arms 12 and 14 are connected by intermediate portion 19, about which clamping arms 12 and 14 rotate through an arc limited by the geometry and materials of device 10. First and second clamping arms 12 and 14 have end portions 16 and 18 respectively. Clamping arms 12 and 14 and intermediate portion 19 are preferably integrally formed by folding a single sheet of steel to form a generally U-shaped high tension steel spring clamp. The steel is preferably an approximately 36/1000 inch thick sheet of 431 stainless steel hardened to approximately 45 C Rockwell. The material and geometry of device 10 give rise to a biasing force between arms 12 and 14 which tends in the direction of arrows A and A', that is to say, to bring arms 12 and 14 together. The biasing force thus provides a clamping force for attaching device 10 to an object such as a wallet. This force is chosen to be of such a magnitude that it cannot be overcome by the bare hands of a typical human being without the aid of a special tool such as tool 100. The biasing force is thus in a range from approximately 12 to approximately 25 pounds, preferably approximately 18 pounds. These force values are obtained by measuring the separation force required between first and second ends 16 and 18 to open the clamp such that the distance between first and second ends 16 and 18 is approximately ¼".

Figure 2:
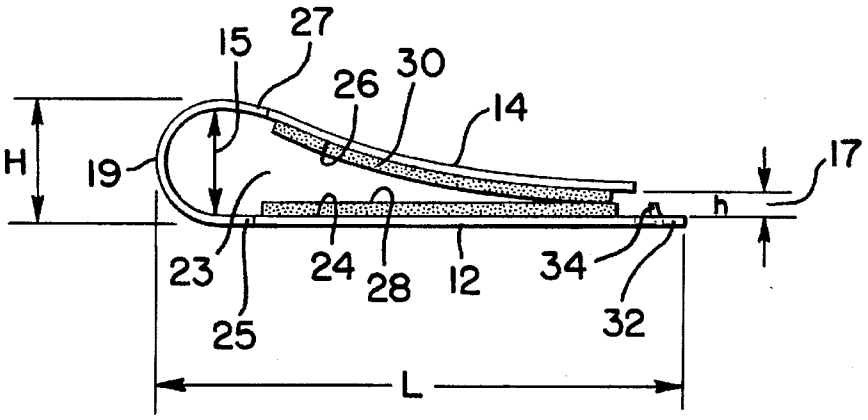
FIG. 2 is a side elevational view of the theft deterrent device.

The U-shape of the clamp defines a gap 23 between arms 12 and 14. Gap 23 tapers down from a first width 15 ("H")

adjacent intermediate portion 19 to a second width 17 ("h") distal of intermediate portion 19 and adjacent end portion 18 of second clamping arm 14. Second clamping arm curves slightly between intermediate portion 19 and end portion 18. This is shown in FIG. 2.

Figure 1:
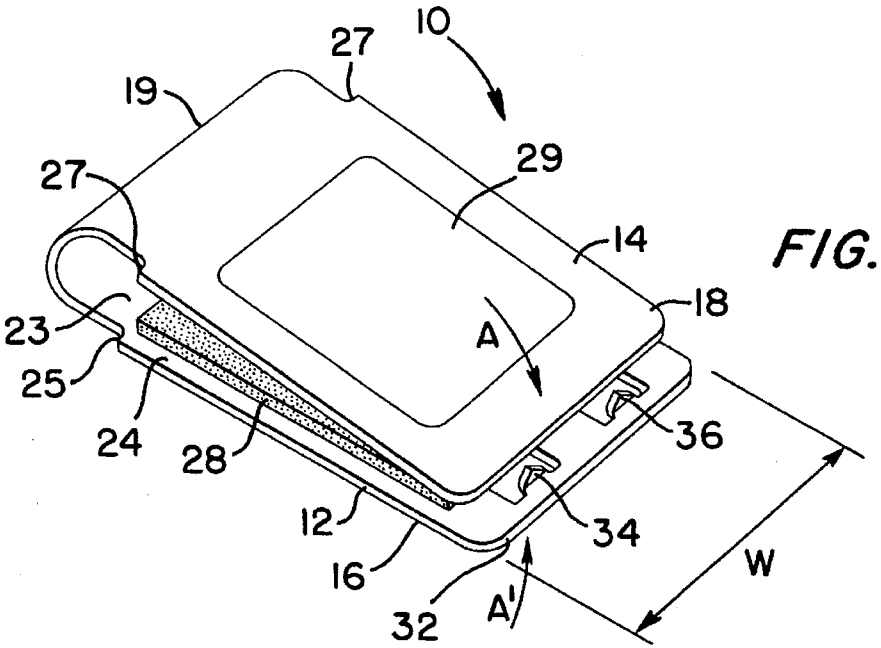
FIG. 1 is a perspective view of the theft deterrent device of the invention.

As can be seen in FIG. 1, first clamping arm 12 has an extended end 32 which slightly extends beyond end 18 of second clamping arm 14. This extended portion is provided with teeth 34 and 36 having sharp points which protrude in the direction of second clamping arm 14. Teeth 34 and 36 are formed by simply cutting sections out of extended end 32 such that generally V-shaped members are left behind and bending the V-shaped members up towards first clamping arm 14. Any sharp edges or burrs left on the V-shaped members by the cutting process are desirable and are not removed. Although not preferred, second clamping arm 14 may also or alternatively be provided with teeth.

First and second clamping arms 12 and 14 have inner surfaces 24 and 26 respectively. Inner surfaces 24 and 26 are respectively provided with padding in the form of first and second pads 28 and 30. Pads 28 and 30 are made of rubber having a medium durometer in a range from approximately 40 to approximately 60 (a range of 40–80 is acceptable). Pads 28 and 30 are about 1/16 of an inch thick.

Intermediate portion 19 is narrower than the rest of first and second clamping arms 14 and 16. Consequently the edges of first and second clamping arms have stepped portions 25 and 27 so that device 10 can fit into the jaws of tool 100.

Figure 3:
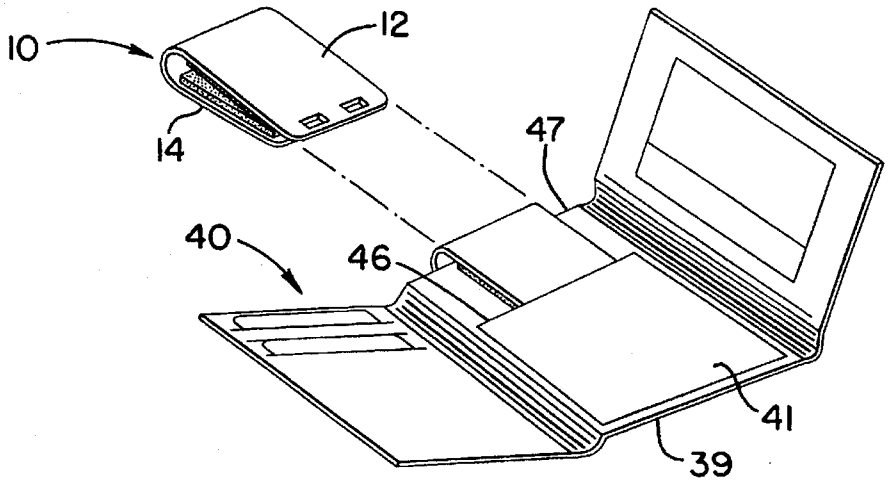
FIGS. 3, 4 and 5 are perspective views showing the theft deterrent device attached to objects of different kinds.
Figure 5:
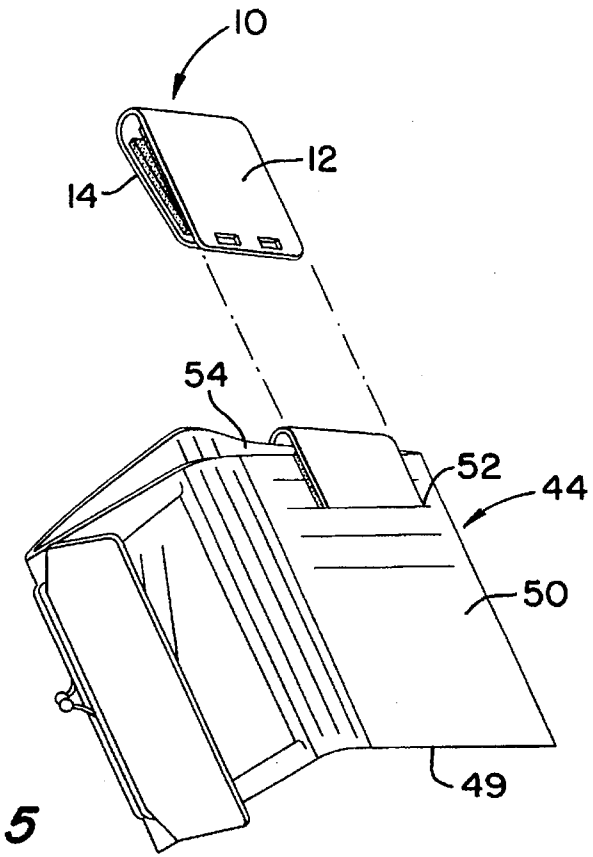
Figure 4:
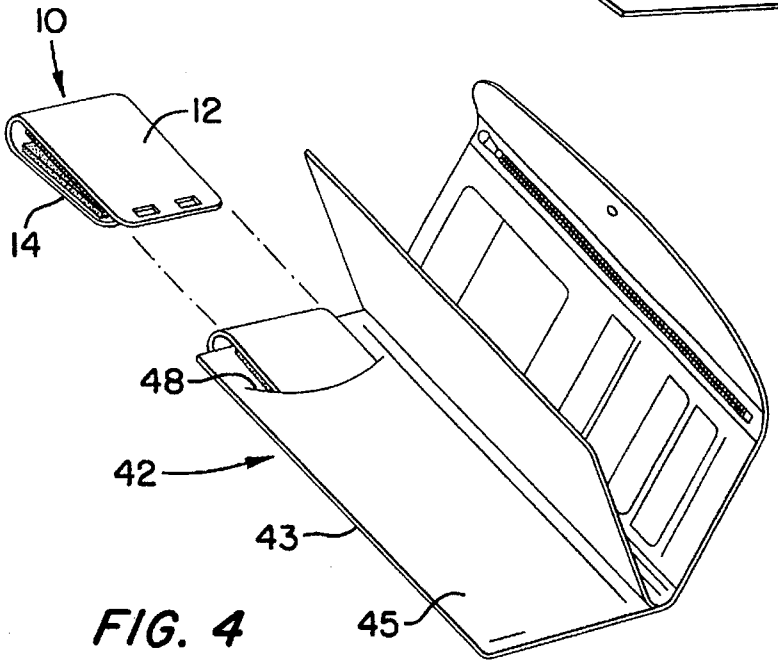

FIGS. 3, 4 and 5 show a theft-deterrent device in use. Device 10 is secured to objects 40 (FIG. 3), 42 (FIG. 4) or 44 (FIG. 5) to deter their theft (from a retail store, for example). The device may be used with a variety of wallet-like objects such as organizers or purses as well as cigar cases, compacts and the like. The term "wallet" is intended to cover all such objects. By way of example and not limitation, objects 40, 42 and 44 are respectively a wallet, a checkbook wallet and a pocketbook. The term "wallet" as used in the following description is intended to encompass objects 40, 42 and 44 and all other like objects to which device 10 can be applied.

When anti-theft device 10 is attached to an object as shown in FIGS. 3, 4 and 5, object 40, 42 or 44 is held between first and second clamping arms 12 and 14. The biasing force in the direction of arrows A and A' (See FIG. 1) urges clamping arms 12 and 14 closed, thus clamping device 10 to object 40, 42 or 44 and making it practically impossible for a human being to remove device 10 by hand without the aid of a special tool such as tool 100.

The fact that device 10 is difficult to remove from objects 40, 42 and 44 means that a potential thief is deterred from stealing the wallet due to the fact that it is at least partially inoperative with device 10 attached to it. The gripping of the wallet by theft deterrent device 10 is enhanced by pads 28 and 30 which are disposed between the clamping arms and the wallet and are maintained in contact with the wallet due to the biasing force between arms 12 and 14. The curvature of clamping arm 14 ensures good contact between pad 30 and the wallet. Due to the nature of the material of the pads there is a relatively high coefficient of friction between the pads and the wallet. When device 10 is clamped to the wallet, the clamping of arms 12 and 14 causes an enhanced frictional force to exist between device 10 and the wallet, making it more difficult to slide the wallet out of device 10.

Device 10 is oriented such that teeth 34, 36 are close to and face a surface of the wallet. Due to the thickness of pads 28 and 30, teeth 34 and 36 are normally not in contact with the wallet. However, if an attempt is made to remove device 10 from wallet 40 by separating the clamping arms, teeth 34, 36 will cut into the wallet, causing severe damage, unless tool 100 is used to remove device 10. Pads 28 and 30 prevent damage to the wallet as long as no attempt is made to slide the wallet out of device 10.

In addition to the "benefit denial" effect of device 10, one of a variety of magnetic or electronic article surveillance tags, well known in the art can be attached to it. Device 10 with tag 29 attached can therefore be used in an electronic article surveillance system. See FIG. 1.

In FIG. 3, device 10 is shown partially inserted into pocket 46 of wallet 40, gripping the wallet tightly and closing the billfold 47. Wallet 40 has a first (outside) surface 39 and a second (inside) surface 41. Pocket 46 lies between first surface 39 and second surface 41. A portion of first clamping arm 12 is inserted into pocket 46, thus closing it. Second clamping arm 14 abuts surface 39. Teeth 34 and 36 face the inside of pocket 46. The clamping of device 10 onto wallet 40 such that pocket 46 and billfold 47 are closed means that wallet 40 is rendered at least partially inoperative, thus denying its benefit and making the theft of wallet 40 less attractive. However, this arrangement still permits a customer to examine wallet 40.

Device 10 is preferably oriented such that teeth 34 and 36 are inside pocket 46 so that under normal customer handling of the wallet 40, the outer surface of the wallet will not be damaged. Further, if a thief makes a forcible attempt to remove the device 10 from wallet 40 without using tool 100 or 200, teeth 34 and 36 will cut into the inside wall of pocket 46, causing even greater resistance to the forced removal attempt. Further application of force will cause the teeth 34 and 36 to rip the material from which wallet 40 is made, thus rendering the wallet unappealing to the potential thief. To enhance the theft deterrent effect, a notice may be placed in a prominent location in the sales area, and/or on the visible clamping arm 14 to inform the public and potential thieves that the wallet will be damaged if an attempt is made to remove device 10.

In FIG. 4, device 10 is shown attached to check book wallet 42, having a first surface 43 and a second surface 45. A slot 48 into which the back cover of a check book can be inserted lies between first and second surfaces 43 and 45. When device 10 is attached to check book wallet 42, second clamping arm 14 is in contact with first surface 43. First clamping arm 12 is inserted into slot 48, thus impeding the insertion of a check book and such that teeth 34 and 36 face the inside of slot 48. Check book wallet 42 is thus partially inoperative with device 10 attached to it in the manner just described. The attempted forced removal of device 10 without the use of the tool 100 or 200 will cause teeth 34 and 36 to cut into check book wallet 42, thus making it less desirable to the potential thief.

In FIG. 5, device 10 is shown attached to pocket book 44. Pocket book 44 has a first outside surface 49, a second inside surface 50, a credit card slot 52 and a billfold 54 between the inside and outside surfaces. As in FIGS. 3 and 4, second clamping arm 14 is in contact with first surface 49. First clamping arm 12 is inserted into credit card slot 52 such that teeth 34 and 36 face the inside of slot 52. Credit card slot 52 and billfold 54 are thus closed. Pocket book 44 is thus rendered partially inoperative.

In each of the instances shown in FIGS. 3, 4 and 5, the object can be displayed and examined for purchase, but if an attempt is made to remove device 10 from the object without the use of a special tool like tool 100, the wallet will be damaged by teeth 34 and 36. It is also very difficult to remove device 10 from the objects without the special tool due to the bias of clamping arms 12 and 14 and the enhanced friction between pads 28 and 30 and the object.

The preferred embodiment of device 10 is intended to be attached to a typical wallet. Each wallet is typically supplied and displayed in its own package such as a box which is only slightly larger than the wallet itself. Device 10 must therefore be dimensioned such that it can be attached to the wallet and included in any packaging with which the wallet is supplied and/or displayed. The preferred dimensions of device 10 are approximately as follows:

length L—2"

width W—1.25"

height H—0.4"

In order to provide the maximum frictional force, the surface area of pads 28 and 30 is made as large as possible. In the preferred embodiment, the pads have the following dimensions:

length—1⅛"

width—1.0"

height—1/16"

The preferred embodiment of attachment/detachment tool 100 will now be described in detail. Tool 100 is specially designed to attach clamp 10 to and remove it from an object. Tool 100 is therefore adapted to hold clamp 10 in place and to spread apart first and second clamping arms 12 and 14.

The following description refers to the device shown in FIGS. 6, 7 and 8. Tool 100 comprises two levers 120 and 140 in a pistol-like configuration. Lever 120 has a hand grip 122 and a jaw 124. Lever 140 is also made up of a hand grip 142 and a jaw 144. Levers 120 and 140 are pivoted about pin 160 (See FIG. 7) so that they can rotate through an arc which is limited by jaws 124 and 144 and surfaces 123 and 143 of levers 120 and 140 respectively.

Hand grip 142 has a rear surface 146 adapted to be held against the palm of the user's hand like the butt of a pistol. Bottom end 148 of lever 140 is provided with a roll pin (not shown) to secure a lanyard to tool 100 so that tool 100 can be secured to a checkout desk.

Tool 100 is symmetrical about its central longitudinal axis. For simplicity, identical left hand elements will be identified by the same numerals used to identify right hand elements. Left hand elements will be designated with prime indications (').

Lever 140 is hollow as shown in FIGS. 6 and 8. Consequently, lever 140 has parallel walls 141 and 141'. Top end 150 of lever 140 has a flat surface provided with a pair of screw holes 152, 152' (See FIG. 8). Jaw 144 has a proximal end 154 and a distal end 156. Proximal end 154 is provided with a pair of countersunk screw holes 158, 158' which align with screw holes 152, 152'. A pair of flat screws go through holes 152 and 152', thereby securing jaw 144 to hand grip 142. Distal end 156 of jaw 144 is slightly wider than proximal end 154 in order to accommodate clamp 10.

Jaw 144 is provided with a pair of parallel flanges 161, 161' running from distal end 156 towards proximal end 154 (See FIGS. 6 and 7). Flanges 161, 161' are substantially perpendicular to flat surface 157 of jaw 144 and are respectively provided with grooves 163, 163' for receiving an edge of clamp 10 (See FIG. 8). Grooves 163, 163' run along the length of flanges 161, 161'.

Jaw 124 is substantially perpendicular to hand grip 122 of lever 120. Hand grip 122 is hollowed out in order to reduce the amount of material used and hence the weight of tool 100. Extending from hand grip 122 substantially perpendicular to jaw 124 is a hinge member 126 (See FIG. 8) which is provided with a through hole 128. Hand grip 140 is provided with through holes 148, 148' (See FIG. 7) which are aligned with through hole 128. Pin 160 passes through holes 128 and 148, 148'. A hinge is thus formed between levers 120 and 140. A plastic cap 151 covers the hinge as a well as screws 160, 160' (See FIG. 6). Plastic cap 151 is secured to lever 140 by means of a single flat screw (not shown).

Levers 120 and 140 are lightly biased apart by spring 190 which is disposed between levers 120 and 140 (See FIG. 8). In order to locate spring 190, levers 120 and 140 are respectively provided with recesses 129 and 149. The ends of spring 190 are located in recesses 129 and 149. Spring 190 exerts a force such that hand grips 122 and 142 are gently pushed apart in the direction of arrows B and B', thus tending to bring jaws 124 and 144 together.

Member 170 is secured to jaw 124 in order to receive device 10. Viewed from the side as in FIG. 7, member 170 is generally triangular, having a base 176 and a truncated apex 180, 180'. Viewed generally from the front as in FIG. 6, member 170 has two parallel walls 172, 172' extending perpendicularly from base 176. Each wall is provided with a flange 178, 178' at its apex 180, 180'. Flanges 178, 178' are adapted to receive the edges of second clamping arm 12 of device 10. Device 10 has stepped portions 25 and 27 in the region of intermediate portion 19 to provide clearance so that device can be inserted into jaws 124 and 144.

In order to assist in the application and removal of a device 10 from a wallet or other article being protected, jaws 124 and 144 are biased to a slightly open position in their equilibrium state. A preset opening of distance "h," approximately equal to first width 15 of device 10 (See FIG. 2) is normally maintained between flanges 161, 161' and 178, 178' by spring biasing jaws 124 and 144. Jaws 124 and 144 are easily closed against the spring bias by slight finger pressure separating levers 120 and 140 from the equilibrium state.

The spring biased preset opening is provided by spacer assembly 192 which is made up of counter bore hole 197 in hand grip 142, spacer screw 195 which is secured to threaded lug 193 (which is in turn secured to hand grip 124 by dowel pin 194), and coil compression spring 196 which is housed in hole 197 (See FIG. 8). The diameter of hole 197 is slightly larger than the outside diameter of spring 196 so spring 196 can flex freely. The diameter of the head of spacer screws 195 is slightly less than the diameter of hole 197, but larger than the inside diameter of spring 196. Thus the head of screw 195 provides an abutment for one end of spring 196, as shown in FIG. 8. The second end of spring 196 abuts the shoulder of the counter bore of hole 197. The threaded shaft of screw 195 is such that is passes freely through the coils of spring 196 and through the smaller hole of the counter bore hole 197 and finally the threaded end of screw 195 is secured to threaded lug 193.

The compression spring 196 has a spring constant such that it is compressed by about 5% when jaws 124 and 144 are in the equilibrium state. When levers 120 and 140 are squeezed together, the head of spacer screw 195 loses contact with spring 196 and spring 196 has no influence. When levers 120 and 140 are released, spring 190 causes the jaws 124 and 144 to close to the point where the head of spacer screw 195 contacts compression spring 196. At this point the closing process slows and will stop when the closing pressure provided by spring 190 is equalized by the compression pressure of spring 196. This point is designed to be when spring 196 is compressed by approximately 5%. Thus equilibrium is attained, when the jaws 124 and 144 are at opening $h_1$, $h_1$ being adjusted by screw 195. When it is required to close the jaws fully, manual finger pressure is applied pushing levers 120 and 140 apart from the equilibrium state; this pressure is sufficient to compress compression spring 196 to the point where jaws 124 and 144 close.

The following is a description of a method by which tool 100 is used to attach device 10 to an object. Jaws 124 and 144 are held in equilibrium or a closed position and tool 100 is preferably laid on a flat surface parallel to hand grip 142. First clamping arm 12 slides into grooves 163, 163' of jaw 144. Second clamping arm 14 slides under flanges 178 and 178' of member 170 on jaw 124 such that device 10 is held securely in jaws 124 and 144. When device 10 is correctly positioned in jaws 124 and 144, intermediate portion 19 of device 10 abuts walls 141 and 141' of hand grip 142 in the vicinity of hinge member 126. When device 10 is securely in place, the user squeezes hand grips 122 and 142 together against the bias of spring 190 and the biasing force of device 10, rotating the hand grips about pin 160. Since device 10 is secured in grooves 163 and 163' and under flanges 178, 178', the squeezing together of the hand grips causes first and second clamping arms 12 and 14 to be spread apart. With first and second clamping arms spread, device 10 is attached to the wallet 40, 42 or 44 as shown in FIGS. 3, 4 and 5 preferably by inserting jaw 144 and hence clamping arm 12 into an opening in the wallet. Jaws 124 and 144 are then allowed to close (mainly due to the bias of device 10 and to a lesser extent due to the bias of spring 190). The user then slides device 10 out of jaws 124 and 144, leaving device 10 firmly clamped to wallet 40, 42 or 44.

Device 10 is removed from the wallet in the following manner. Tool 100 is gripped by lever 140 only and positioned such that the edges of first clamping arm 12 align with grooves 163, 163'. The edges of second clamping arm 14 will automatically align with flanges 178, 178'. The wallet and attached device 10 are brought towards hinge member 126 until the intermediate member of device 10 abuts walls 141 and 141' of hand grip 142 in the vicinity of hinge member 126. When device 10 is securely located in jaws 124 and 144, hand grips 122 and 124 are squeezed together against the bias of spring 190, thus spreading first and second clamping arms 12 and 14. With device 10 in position in jaws 124 and 144, device 10 and tool 100 are withdrawn so that device 10 is fully separated from the wallet without damaging it. Hand grips 124 and 144 can then be released. Device 10 then slides out of jaws 124 and 144 when finger pressure is applied between levers 120 and 140 to spread the jaws.

A description of a second embodiment of the attachment and detachment tool 200 follows. Reference is made to FIGS. 9 and 10. For clarity, the wallet is omitted from FIGS. 9 and 10. Tool 200 is a spreading tool generally resembling pliers or a spring spreader. Tool 200 is made up of first lever 202 and second lever 204. First and second levers 202 and 204 are made of steel. Levers 202 and 204 respectively have engagement ends (jaws) 206 and 208 and leverage ends (handles) 210 and 212. First lever 202 is bent at a slight angle (preferably an angle of approximately 30°). As a result jaw 206 and handle 210 are slightly offset from each other. Second lever 204 is substantially flat so that jaw 208 and handle 212 lie in a generally straight line. This permits tool 200 to be laid flat. Tool 200 is symmetrical about its central longitudinal axis. Where right hand elements are identified by numerals, identical left hand elements are designated by the same numerals primed (′). However, left hand numerals are omitted from the drawings for clarity.

First lever 202 is provided with integral flanges 214 and 214', extending substantially perpendicular to the plane of handle 210. Second lever 204 is provided with similar flanges 216 and 216' which are integral with lever 204 and extend substantially perpendicular to the plane of the handle of the second lever. Flanges 214 and 214' and 216 and 216' are oriented such that they interlock as shown in FIGS. 9 and 10. The flanges are provided with through holes through which pivot pin 224 is disposed such that a hinge is formed by the flanges and pin 224. Levers 202 and 204 can rotate with respect to each other about pin 224.

Spring 218 is held between the first and second levers on post 220 on the inside surface of the handle of the first lever and post 222 on the inside surface of the second lever. Spring 218 provides a biasing force which tends to separate the first and second handles by biasing them in the direction of arrows B and B'. Spring 218 is a coil spring having a spring constant of approximately 2 lbs per inch. One or more leaf springs disposed between the two handles may also be used in place of a coil spring.

Retainer 239 is disposed slidably between the first and second levers. Retainer 239 is made up of two generally L-shaped flat plates each having vertical part 230 and 230' and horizontal parts 232 and 232' which are joined by a cross-member. Horizontal parts 232 and 232' are provided with slots 234 and 234' through which pivot pin 224 extends such that retainer 239 is slidable relative to the first and second levers.

Jaws 206 and 208 of first and second levers 202 and 204 are respectively provided with catches 236 and 238. The catches are provided with flanges 240 and 242 which are adapted for engagement with first and second ends 16 and 18 of clamping arms 12 and 14 of device 10. Catches 236 and 238 are secured to the jaws of the first and second levers by rivets 246 and 248 but may be constructed in a number of ways, for example by simply bending the jaws of the first and second arms to provide flanges to mesh with first and second ends 16 and 18.

When tool 200 is in its equilibrium state (a first position), the bias of spring 218 tends to force handles 210 and 212 apart in the direction of arrows B and B'. Consequently, jaws 206 and 208 tend to be forced together. When force is applied to handles 210 and 212 in the direction indicated by arrows C and C', handles 210 and 212 are brought towards each other against the bias of spring 218 (to a second position as shown in FIG. 10). Jaws 206 and 208 are thus opened.

As can be seen in FIG. 9, when tool 200 is in the first position, a generally triangular area 250 is formed between the jaws of the first and second levers. This area is designed to accommodate the tapered generally U-shaped device 10 which was described above. In order to clamp device 10 to an object such as a wallet, jaws 206 and 208 are opened and device 10 is placed in the triangular area between jaws. To secure device 10 in position, retainer 239 slides backwards towards handle 210. Once device 10 has been correctly placed, retainer 239 slides forward to hold device 10 securely in place. Catches 236 and 238 are brought into engagement with first and second ends 16 and 18 of clamping arms 12 and 14 as shown in FIG. 9. Retainer 239 holds device 10 securely in place, with catches 236 and 238 engaged with first and second ends 16 and 18.

Application of force to handles 210 and 212 in the direction of arrows C and C' (against the bias of spring 218 and the biasing force between first and second clamping arms 12 and 14 of device 10) opens jaws 206 and 208 allowing a wallet to be positioned between first and second clamping arms 12 and 14. Teeth 34 and 36 are brought into position facing a surface of the wallet as described above. When the force on handles 210 and 212 is relaxed, clamping arms 12 and 14 and jaws 206 and 208 are brought together by the biasing force of spring 218 and the biasing force between first and second clamping arms 12 and 14 (The biasing force between the first and second clamping arms of device 10 is much greater than that of spring 218). Device 10 is disengaged from catches 236 and 238 by sliding retainer 239 back towards handle 210 and pushing tool 200 forward so that catches 236 and 238 clear ends 16 and 18 of device 10. The wallet can then be removed from tool 200 with clamping arms 12 and 14 of device 10 firmly gripping the wallet.

Removal of device 10 from the wallet is accomplished as follows. Jaws 206 and 208 are opened slightly and inserted into the wallet so that jaws 206 and 208 generally overlie device 10. Device 10 (with the wallet attached) is placed in the triangular space between jaws 206 and 208. Tool 200 is then pushed forward and moved back such that catches 236 and 238 engage ends 16 and 18 of device 10. Jaws 206 and 208 are then closed. Retainer 239 slides into place to hold device 10 firmly in position and handles 210, 212 are brought together against the bias of spring 218 and device 10. This action opens the jaws of tool 200 and hence first and second clamping arms of anti-theft device 10. The wallet can thus be removed from the anti-theft device without teeth 34 and 36 damaging the wallet.

The above described invention provides a simple and cost effective system and method for deterring the theft of small objects such as wallets in a retail environment. Potential thieves are deterred from removing the wallet from the place of display due to the facts that the anti-theft device is difficult to remove and that removal of the device is likely to result in damage to the wallet which will diminish its value. In addition, with the anti-theft device attached, the wallet is rendered partially inoperative because the billfold, credit card slot or check book slot is closed. Device 10 thus deters theft by denying a benefit of the merchandise if it is stolen.

I claim:

1. A device for deterring theft of an object comprising: first and second arms for clamping the object when said device is attached to the object, said first arm having an end portion that extends beyond said second arm and a tooth located on said end portion and said first arm has a terminal edge; means for providing a clamping force to cause said first and second arms to grip the object firmly such that when said device is attached to the object, said device cannot readily be removed without use of a special tool; padding disposed between said first and second arms and the object such that said end portion between said tooth and said terminal edge is free of padding, said padding providing enhanced frictional force between the object and said first and second arms and preventing said tooth from cutting into a surface of the object when said device is attached to the object unless said second arm is moved relative to said first arm and said device moves relative to the object.

2. A device as recited in claim 1, wherein said means for providing a clamping force comprises means for resiliently clamping said device to the object.

3. A device as recited in claim 1, wherein said means for providing a clamping force provides a clamping force of such magnitude that said device cannot readily be opened by a human being's bare hands.

4. A device as recited in claim 1, wherein said means for providing a clamping force provides a clamping force of at least approximately 12 pounds.

5. A device as recited in claim 1, wherein one of said arms is curved.

6. A device as recited in claim 1, wherein said padding comprises first and second pads secured to said first and second arms respectively.

7. A device as recited in claim 1, further comprising an intermediate member connecting said first and second arms.

8. A device as recited in claim 7, wherein said first and second arms and said intermediate member form a generally U-shaped member such that said first and second arms are biased towards each other.

9. A device as recited in claim 1, wherein said first and second arms define a gap that tapers down from a first width to a second width.

10. A device as recited in claim 1, further comprising an intermediate member connecting said first and second arms and wherein said first and second arms define a gap that tapers down from a first width adjacent said intermediate member to a second width at said end portion of see first arm.

11. A device as recited in claim 1, further comprising a magnetic marker secured to said device.

12. A device as recited in claim 1, further comprising an electronic marker secured to said device.

* * * * *